US005195818A

United States Patent [19]

Simmons et al.

[11] Patent Number: 5,195,818

[45] Date of Patent: Mar. 23, 1993

[54] ELONGATED LAMP

[75] Inventors: Adrian Simmons, Kaarst, Fed. Rep. of Germany; Alberto de la Cruz Garcia, Tres Cantos, Spain

[73] Assignee: Minnesota Mining and Manufacturing Company, Saint Paul, Minn.

[21] Appl. No.: 803,017

[22] Filed: Dec. 5, 1991

[30] Foreign Application Priority Data

Dec. 8, 1990 [DE] Fed. Rep. of Germany ..... 4039290

[51] Int. Cl.[5] ..... F21S 3/00

[52] U.S. Cl. ..... 362/224; 362/299; 362/329; 362/340

[58] Field of Search ..... 362/223, 224, 260, 299, 362/300, 309, 311, 328, 329, 340, 343, 346

[56] References Cited

U.S. PATENT DOCUMENTS

| | | | |
|---|---|---|---|
| 2,175,067 | 10/1939 | Rolph | 240/106 |
| 4,120,565 | 10/1978 | Rabl et al. | 350/286 |
| 4,154,219 | 5/1979 | Gupta et al. | 126/270 |
| 4,242,723 | 12/1980 | Fabbri et al. | 362/224 X |
| 4,260,220 | 4/1981 | Whitehead | 350/96.28 |
| 4,615,579 | 10/1986 | Whitehead | 350/96.1 |
| 4,805,984 | 2/1989 | Cobb, Jr. | 350/96.28 |
| 4,834,495 | 5/1989 | Whitehead et al. | 350/96.28 |
| 4,850,665 | 7/1989 | Whitehead | 350/96.1 |
| 4,874,228 | 10/1989 | Aho et al. | 362/309 X |
| 4,906,070 | 3/1990 | Cobb, Jr. | 350/286 |

FOREIGN PATENT DOCUMENTS

| | | |
|---|---|---|
| 0350436 | 1/1990 | European Pat. Off. . |
| 921846 | 5/1947 | France . |
| 389538 | 7/1965 | Switzerland . |
| 1038480 | 8/1966 | United Kingdom . |

*Primary Examiner*—Stephen F. Husar

*Attorney, Agent, or Firm*—Gary L. Griswold; Walter N. Kirn; Stephen W. Buckingham

[57] ABSTRACT

The lamp has a case with a light exit opening. A reflector is arranged on the rear wall of the case facing the light exit opening, in front of which an elongated light source is arranged. Between the light source and the light exit opening there is a flexible optical film, stable in shape, with a smooth surface and a structured surface. The smooth surface faces the light exit opening, while the structured surface is directed toward the light source. The structure consists of a plurality of V-shaped grooves extending in parallel to each other and transverse to the longitudinal extension of the light source, the grooves lying immediately side by side. The optical film extends only in that area in which the light source emits light directly toward the light exit opening.

14 Claims, 2 Drawing Sheets

FIG.1
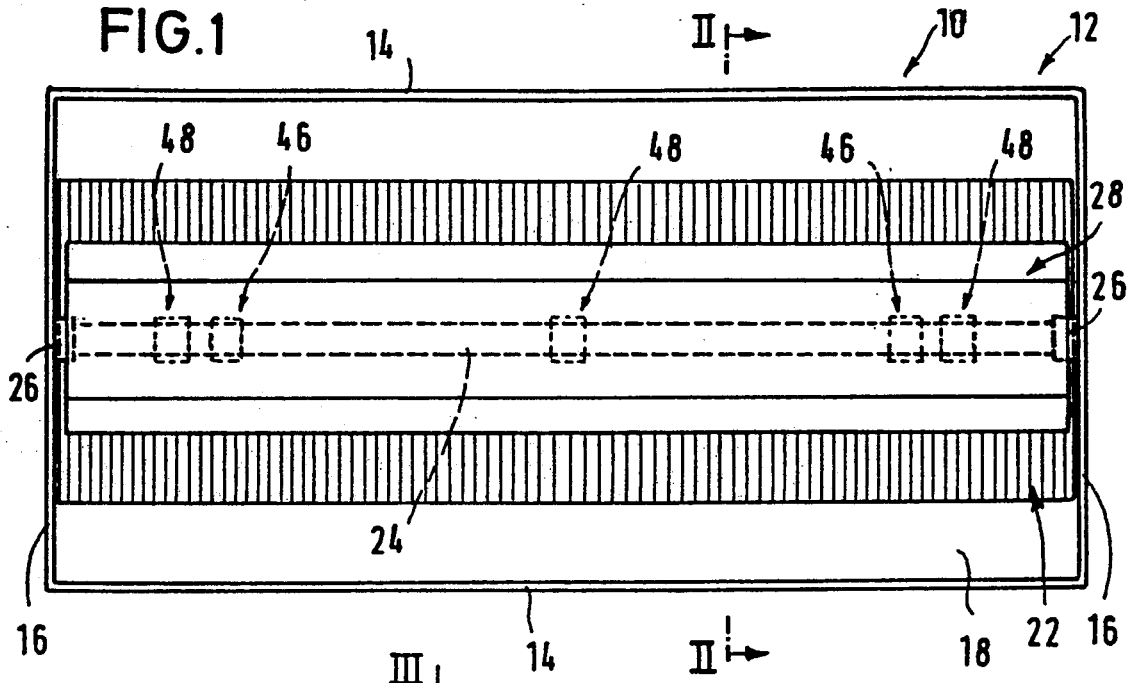
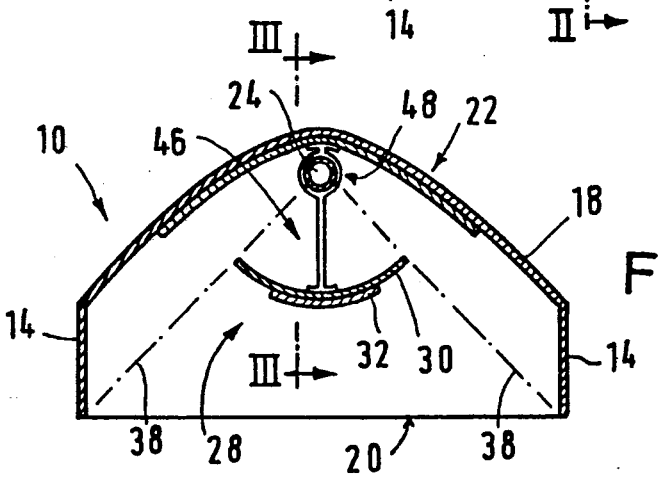
FIG.2
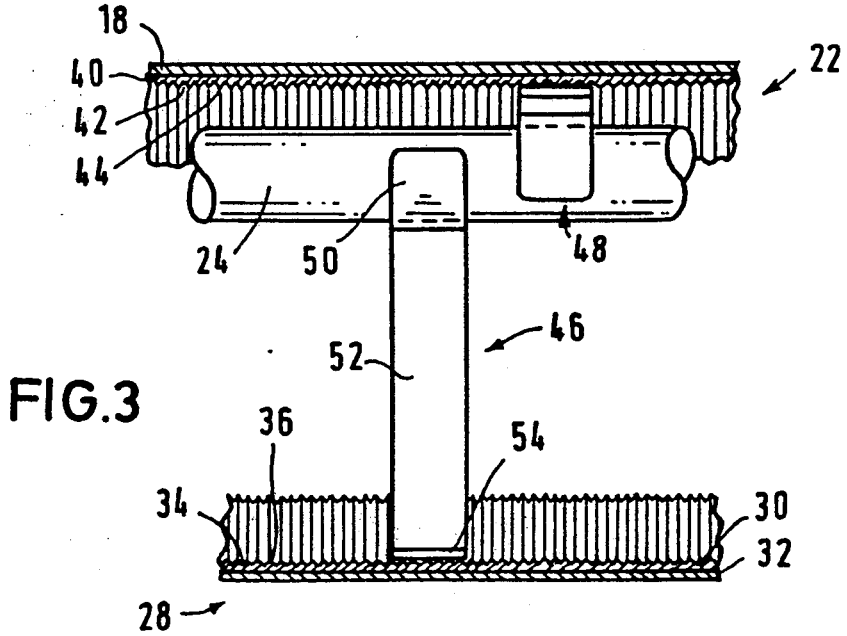
FIG.3

FIG. 4
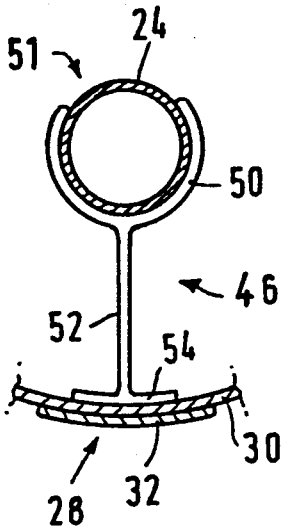
FIG. 5
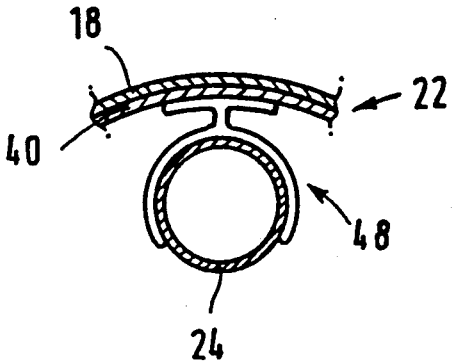
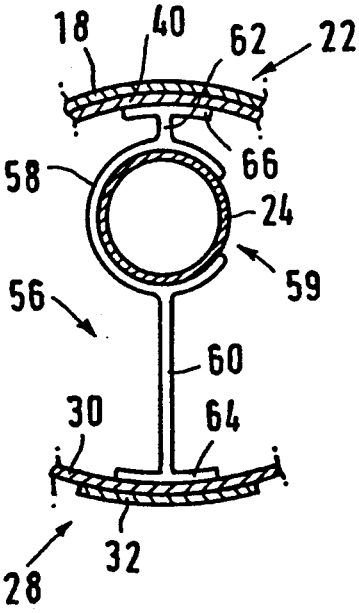
FIG. 6

ELONGATED LAMP

The invention relates to a lamp with a case having a light exit opening, an elongated source of light and a reflector.

One requirement often to be met by lamps is that the light exit opening is illuminated evenly, i.e. without substantial variations in the concentration of luminance. This is particularly desirable with working place luminaires, but also with so-called light boxes in which the light exit opening is closed by a transparent plate that is back-lit. A light box in the sense of this application is a lamp having its light exit opening arranged in the case and closed by a plate or the like to be evenly back-lit.

A lamp of the type initially mentioned is known from European Patent 0 350 436. The lamp has a case that is provided with a light exit opening and a reflector arranged on the inner wall opposite the light exit opening. In front of the reflector there is an elongated light source in the form of a fluorescent tube. A curved cover plate of transparent material is arranged between the light exit opening and the light source, which terminates at the inner walls of the case. On the outer surface facing to the light exit opening, the cover plate has a plurality of mutually parallel and adjacent V-shaped grooves extending transversal to the longitudinal extension of the light source. Since the flanks of the V-shaped grooves are immediately adjacent to each other, prism strips are formed, the flanks of which define the V-shaped grooves. With the known prism cover, only lamps with a comparatively narrow case can be realized, the case having a rather large constructional depth. All light beams emitted by the light source have to pass the transparent cover plate in order to exit via the light exit opening. The light exiting from the cover plate in the area closer to the light source is more intense than the light exiting from the remaining area of the cover plate.

It is an object of the invention to provide a lamp of the type mentioned above, in which the light exit opening is evenly illuminated.

According to the invention, the object is solved by providing a flexible transparent optical film, stable in shape, between the light exit opening and the light source, which has a smooth first surface and a structured second surface facing to the light source, and which is provided with mutually parallel and adjacent substantially V-shaped grooves extending transversal to the longitudinal extension of the light source, and by the optical film extending in the case only over an area in which the light source emits its light directly towards the light exit opening.

According to the present invention, a flexible, dimensionally stable, optical film of a transparent material, preferably polycarbonate or polymethacrylate, is used for screening the light exit opening against light emitted by the light source directly towards the light exit opening. This optical film has a smooth surface on the one side and a structured second surface on the other side, which is provided with mutually parallel and adjacent substantially V-shaped grooves and prisms. The optical film is arranged or orientated such that its structured surface is facing the light source, the grooves and prisms extending transversal to the longitudinal extension of the light source. The optical film, which is arcuate in cross section and curved concavely with regard to the light source, and which extends along the light source, is arranged only in that region where the light from the light source is emitted directly towards the light exit opening. This area is determined by the geometry of the lamp, in particular by the size of the light exit opening, the distance between the light exit opening and the light source and the distance between the optical film and the light source.

Due to the prism structure in the central portion of the light exit opening, seen in the direction of projection, facing the light source, the light that does not penetrate the optical film is reflected and distributed to both sides, where it contributes to an even illumination of the light exit opening, thus allowing to design it with a comparatively large surface. This even illumination of the large light exit opening is achieved although the constructional depth of the case is comparatively low.

Due to the surface structure of the optical film, the light exits at different angles from the plane surface facing the light exit opening so that a comparatively uniform distribution of light occurs behind the optical film, seen in the direction of the diffusion of the light. The light exiting from the light exit opening is composed of light beams penetrating the optical film, possibly after multiple reflection by the film and the reflector, and such light beams that are reflected past the optical film towards the light exit opening after having been reflected at the reflector. Thus, the present arrangement and the orientation of the optical films with the V-shaped grooves and prisms achieve a uniform distribution of the light emitted from the light source directly towards the light exit opening. The main reason for this is that the light of the light source impinges on the optical film with its sawtooth-shaped cross section, which results in various light beam paths. Depending on the angle of incidence at which the light impinges on the structured surface of the optical films, a total reflection or a refraction occurs. The refracted light beams either exit from the plane surface of the optical film or they are reflected there in order to exit from the structured surface of the optical film. However, a total reflection of the light beams may also occur at the structured surface. This multiplicity of possible light beam paths makes the light reaching the light exit opening more even and allows a relatively even illumination of the light exit opening even if the same has a comparatively large surface.

In principle, the prism and groove structure of the optical film is optional, provided that the prisms and grooves extend transverse, i.e. perpendicular, to the longitudinal extension of the light source. The optical properties of the optical film having the structure described above, however, are most favorable with a view to a more even distribution of the light, if the flanks of the grooves and prisms extend at an angle of 90 degrees with respect to each other, each flank extending at an angle of 45 degrees to the smooth surface of the optical film. Preferably, the grooves are of equal depth so that equal angle prisms (and thus equal angle grooves) are obtained. Preferably, an optical film that is designed for implementation in a lamp according to the present invention, has a thickness of about 0.5 mm, the depth of the grooves being about 0.17 mm and the distance between the grooves or the prisms being about 0.35 mm.

Preferably, a plurality of optical films, in particular two optical films, are superposed, the structured surfaces of all optical films being directed towards the light source. By arranging a plurality of optical films one after the other, the distribution of the light is evened further. Preferably, all optical films are arranged concentric and centered with respect to each other, the width of the optical films decreasing as the distance of the optical films to the light source increases. The concentric and centered arrangement of the optical films evens the distribution of the light particularly in the central portion of high light intensity of the light exit opening, which is closest to the light source.

Instead of arranging a plurality of optical films one after the other, it is contemplated in an advantageous embodiment of the present invention to provide a light-scattering diffusion plate on the smooth surface of the optical film facing the light exit opening, the plate possibly being arranged concentric and centered with respect to the film. The diffusion plate contributes to a further more even distribution of the light in the central portion of the light exit opening. The diffusion plate is preferably configured as a narrow plate strip lying on the optical film. Since a particular purpose of making the illumination of the light exit opening more even is to compensate the differences in light intensity of the central portion, which is closest to the light source, and the peripheral portions of the light exit opening, the diffusion plate, necessarily also attenuating the light, only extends over the central portion of the optical film. For the same reason, a plurality of optical films is always arranged in centered relationship in order to distribute the very light in the central portion to the peripheral portions.

Preferably, the light source is a fluorescent tube, the optical film or the optical films and, if provided, the diffusion plate extending substantially concentric to the fluorescent tube.

The optical film provided in the lamp of the present invention may advantageously also be implemented in a light box wherein one side or surface of the case carrying an information is lit from the rear. Typically, a light box is a lamp having its light exit opening closed by a transparent plate which is evenly backlit.

According to an advantageous embodiment of the invention, a transparent support plate is arranged in the case for retaining the optical film, which is concave relative to the light source and which is arcuate in cross section. This transparent support plate carries the optical film on its inner surface facing to the light source, the film thus also being arcuate in extension. Should a diffusion plate or a further optical film be used in addition to the optical film, it is preferably arranged on the outer surface of the support plate facing the light exit opening.

According to a further advantageous embodiment of the present invention, the optical film is retained by at least one holding element of transparent material which may be plugged on the light source and fixed thereon by clamping. The fixing of the optical films by clamping forces applied through holding elements to be plugged onto the light source offers advantages for the production of the lamp and for the retrofitting of installed lamps with a cover for the light source in the form of the optical film. The clamping force exerted by the holding element ensures a reliable and secure positioning of the film with respect to the light source and a fixation of the film in the position once taken.

Advantageously, the transparent holding element of flexible material is provided with a clamp member to be plugged onto the fluorescent tube, enclosing more than 180 degrees, preferably up to 270 degrees, of the circumference of the fluorescent tube and having a spacing bar formed thereon which extends radial to the fluorescent tube when the clamp member is plugged onto the same. The free end of the spacing bar having a transversal supporting bar to which the optical film is fastened. The spacing bar defines the distance between the optical film and the fluorescent tube. The supporting bar may either extend rectangular to the spacing bar or it may be curved corresponding to the curvature of the optical film to be fastened thereon. On the one hand, the distance between the optical film and the light source, i.e. the height of the spacing bar of the holding element, depends on the diameter of the fluorescent tube and, on the other hand, on the distance of the fluorescent tube to the exit opening.

The reflector of the lamp of the present invention may be a mat white plate or a conventional mirror reflector. The reflector should extend evenly on both longitudinal sides of the light source so that light from the light source exiting laterally is reflected towards the light exit opening in the same way and the same direction on both sides, thereby allowing a relatively wide light exit opening which is still evenly illuminated. Advantageously, an optical film is also used as the reflector, having the same design and the same surface structure as the optical film of the cover of the lamp. Should an optical film be used as the reflector, the V-shaped grooves and prisms preferably extend perpendicular to the longitudinal extension of the light source, which is favorable for the even illumination of the light exit opening. Here, the grooves and prisms face to the light source.

The following is a detailed description of an embodiment of the invention with reference to the accompanying drawings:

FIG. 1 is a vie *w* of the lamp seen from the side of the light exit opening,

FIG. 2 is a view along the line II—II in FIG. 1,

FIG. 3 a section along line III—III in FIG. 2,

FIG. 4 is an upscaled view of one of the holding elements with which the optical film is fixed to the fluorescent tube, FIG. 5 is an upscaled illustration of a holding element with which the reflector is fixed to the fluorescent tube, and FIG. 6 is an upscaled view of a holding element with which both the optical film and the reflector are fixed to the fluorescent tube.

FIGS. 1 to 3 illustrate the configuration of a lamp 10 according to the invention. According to FIG. 1, the lamp 10 has a substantially rectangular case 12 consisting of two parallel longitudinal side walls 14 and two mutually parallel transversal side walls 16 extending rectangularly to the longitudinal side walls. The rear wall 18 of the case 12 is curved outward, as illustrated in FIG. 2, while the front wall opposite the rear wall 18 has the light exit opening 20 provided therein. The light exit opening 20 extends over the entire front wall of the case 12. A reflector 22 is arranged on the inner surface of the curved rear wall 18, which lies on the rear wall 18. Arranged in the case 12, there is an elongated light source in the form of a fluorescent tube 24 extending in parallel to the longitudinal side walls 14 and over the entire length of the case 12. The fluorescent tube 24 is supported at its ends by the sockets indicated at 26. The fluorescent tube is located in the center of the rear wall 18 of the case and immediately in front of the reflector 22.

A transparent screen 28 is provided between the fluorescent tube 24 and the light exit opening 20, which extends over the entire length of the case 12 and "shields" the fluorescent tube 24 against the light exit opening 20. This screen 28 consists of an optical film 30 having a plane surface and a structured surface. The optical film 30 consists of a transparent flexible material, stable in shape, thus having a certain flexural rigidity. The optical film 30 is curved arcuately. On the side of the optical film 30 facing the light exit opening 20, a diffusion plate 32 is arranged centered and concentric to the optical film.

As can be seen in FIG. 3, the structured surface of the optical film is facing the fluorescent tube 24. The structured surface has substantially V-shaped grooves 34 provided therein which extend in parallel to each other and are immediately conterminous. Prisms 36 are formed between the V-shaped grooves 34, the two flanks of a prism 36 corresponding to the adjacent flanks of two adjacent V-shaped grooves 34. The orientation of the optical film 30 is such that the V-shaped grooves 34 and the prisms 36 extend transversal, i.e. perpendicular to the longitudinal dimension of the fluorescent tube 24. The flanks of the grooves and the prisms extend rectangularly with respect to each other, each flank extending at an angle of 45 degrees to the plane surface of the optical film. Since all V-shaped grooves are of equal depth, the prisms 36 are isosceles.

As can be seen in FIG. 2, the optical film 30 only extends over that angular range in which the fluorescent light 24 emits light directly towards the light exit opening 20 of the case 12. In FIG. 2, the angular range of this light is indicated by the broken lines 38. All light emitted directly towards the light exit opening 20 will thus impinge on the V-shaped grooves, 34 and the prisms 36 of the optical film 30, where it is either reflected because of a total reflection or penetrates into the optical film 30, while being refracted. Light reflected from the optical film 30 impinges on the reflector 22 from which it is either reflected back to the optical film 30 or laterally past the optical film 30 towards the light exit opening 20. It is the effect of the arrangement of the optical film 30 between the light exit opening 20 and the fluorescent tube 24, as described and illustrated herein that, due to the reflection of the light at the optical film 30 and the transmission of the light through the optical film 30, the part of the light emitted by the fluorescent tube 24 that, without the optical film 30, would exit at the central portion of the light exit opening 20, is partly reflected or directed to both longitudinal sides of the elongated light source and thus distributed over the entire light exit opening 20.

The strip-shaped diffusion plate 32 provided on the plane face of the optical film 30 which faces the light exit opening 20, causes an additional light scattering favorable to the even illumination of the light exit opening 20.

As illustrated in the Figures, the reflector 22 also is an optical film of the same structure as the optical film 30 of the cover 28. The smooth surface of the optical film 40 of the reflector 22 lies on the inner surface of the rear wall 18, while the structured surface, formed by adjacent and mutually parallel substantially V-shaped grooves 42 and prisms 44, faces the fluorescent tube 24. The grooves 42 and prisms 44 of the optical film 40 extend transversal, i.e. perpendicular to the longitudinal axis of the fluorescent tube 24. The surface areas of the inner side of the rear wall 18 not covered by the optical film 40 are mat white. Due to the groove or prism structure of the optical film 40 of the reflector 22, the largest part of the light impinging on the reflector 22 in the immediate vicinity of the fluorescent tube 24 is not reflected back to the fluorescent tube 24, but past the fluorescent tube 24. Thus, this reflected light is not added to the light emitted from the fluorescent tube 24 directly towards the light exit opening 20, which also leads to a more even illumination of the light exit opening 20.

As indicated in FIGS. 1 to 3, the optical film 30 of the screen 28 and the optical film 40 of the reflector 22 are held by holding elements engaging at the fluorescent tube 24. While the optical film 30 of the screen 28 is held by two holding elements 46, as illustrated in FIG. 4, the optical film 40 of the reflector 22 is held by the three holding elements 48 (see FIG. 5). The holding elements 46 for the optical film 30 of the screen 28 consist of a transparent resilient material and have a clamp member in the form of a sleeve 50 which, at a circumferential portion, has a gap 51 extending axially over the length of the sleeve 50. In cross section, the sleeve 50 is C-shaped. The sleeve 50 may be plugged onto the fluorescent tube 24 by virtue of the gap 51 and encloses the tube in an angular range between 180 degrees and 270 degrees. When set onto the fluorescent tube 24, the sleeve 50 is spread. Due to the resilience of the material of the holding element 46, the sleeve 50 exerts a clamping force on the fluorescent tube 24 so that the holding element 46 is clampingly fixed to the fluorescent tube 24 through the sleeve 50.

Diametrically opposite the gap 51, a radial spacing bar 52 is provided at the sleeve 50, the free end of which has a supporting bar 54 provided thereto, extending transversal to the spacing bar 52. The optical film 30 is glued to the supporting bar 54 by means of a transparent adhesive, the supporting bar projecting beyond the spacing bar 52 at both longitudinal sides. The supporting bar 54 is curved corresponding to the shape of the optical film 30. The holding element 48 is substantially the same as the holding element 46, differing only in that the radial extension of the spacing bar with respect to the sleeve is shorter than in the holding element 46. In general, the height of the spacing bars of the holding elements depends on the configuration of the lamp, in particular on the diameter of the fluorescent tube 24 and its distance to the light exit opening 20.

FIG. 6 illustrates a holding element 56 used to fix both the optical film 30 of the screen 28 and the optical film 40 of the reflector 22 at the fluorescent tube 24. The holding element 56 has a clamp member similar to a sleeve 58, clampingly surrounding 180 degrees to 270 degrees of the circumference of the fluorescent tube 24 and having a longitudinal slot gap 59 of corresponding width. The sleeve 58 has two radially extending spacing bars 60, 62 formed thereon that are arranged diametrically opposite to each other and extending offset by 90 degrees with respect to the gap 59. According to FIG. 6, the gap 59 of the holding member 58 by virtue of which the holding member 58 is plugged onto the fluorescent tube 24, points to a direction perpendicular to the radial extension of the spacing bars 60, 62. At the free end of the spacing bar 60, the supporting bar 64 for supporting the optical film 30 is arranged, while at the free end of the spacing bar 62 that is shorter than the spacing bar 60, the supporting bar 66 for supporting the optical film 40 is arranged.

Further, it should be mentioned that, in the Figures, the thickness of the optical film and the surface structure thereof are not represented in their real dimensions with respect to the other parts of the lamp since, if the Figures were true to scale, the optical film would not be visible anymore. Also the distance between the fluorescent tube and the reflector is not true to scale.

What is claimed is:

1. A lamp comprising a case having a light exit opening, an elongated light source, and a reflector, characterized in that a flexible transparent optical film, stable in shape is arranged between said light exit opening and said light source, said film having a smooth first surface and a structured second surface facing said light source, which second surface is provided with mutually parallel and adjacent substantially V-shaped grooves extending transversal to the longitudinal extension of said light source, and said optical film extends only over an area within said case in which said light source emits its light directly towards said light exit opening.

2. The lamp of claim 1, characterized in that a plurality of optical films are arranged in superposition, the structured surface of all optical films pointing to the light source.

3. The lamp of claim 2, characterized in that all optical films are arranged concentric and centered with respect to each other, and that the width of the optical films decreases as their distance to the light source increases.

4. The lamp of claim 1, characterized in that a diffusion plate is provided on the smooth surface of the optical film facing the light exit opening, the diffusion plate being arranged concentric and centered relative to the optical film.

5. The lamp of claim 4, characterized in that said diffusion plate is narrower than the optical film on which it is arranged.

6. The lamp of claim 1, characterized in that the optical film comprises a polymer selected from the group consisting of polycarbonate and polymethacrylate.

7. The lamp of claim 6, characterized in that said light source is a fluorescent tube.

8. The lamp of claim 7, characterized in that the optical film extends concentric with respect to the fluorescent tube.

9. The lamp of claim 1, characterized in that the light exit opening is closed by a transparent plate back-lit by the light from the light source.

10. The lamp of claim 1, characterized in that a transparent support plate is arranged in the case, said plate being concavely curved relative to the support plate and supporting the optical film on its inner surfaces facing said light source.

11. The lamp of claim 4, characterized in that the support plate has the diffusion plate provided on its outer surface facing the light exit opening.

12. The lamp of claim 1, characterized in that the optical film or, in the case of a plurality of optical films, one of the optical films is fastened to at least one holding element of transparent material that may be plugged onto said light source and may be fastened thereto by clamping.

13. The lamp of claim 12, characterized in that said holding element consists of resilient material and has a clamp member which may be plugged onto the fluorescent tube and surrounds the fluorescent tube over more than 180 degrees, preferably up to 270 degrees, of its circumference and at which a spacing bar is provided, having a supporting bar formed at its free end, to which the optical film is fastened.

14. The lamp of claim 13, characterized in that the optical film is glued to the at least one holding element by means of a transparent adhesive.

* * * * *

UNITED STATES PATENT AND TRADEMARK OFFICE

CERTIFICATE OF CORRECTION

PATENT NO. : 5,195,818

DATED : March 23, 1993

INVENTOR(S) : Adrian Simmons and Alberto de la Cruz Garcia

It is certified that error appears in the above-identified patent and that said Letters Patent is hereby corrected as shown below:

Column 7, line 28, "surface" should read -- surfaces --.

Signed and Sealed this

Twenty-eighth Day of December, 1993

*Attest:*

Bruce Lehman

BRUCE LEHMAN

*Attesting Officer*

*Commissioner of Patents and Trademarks*